United States Patent [19]

Saviolo

[11] Patent Number: 4,669,260

[45] Date of Patent: Jun. 2, 1987

[54] VERTICALLY-ARRANGED RUBBING FINISHER HAVING SYMMETRICALLY-LOCATED OUTPUT BOBBINS WITH SINGLE SLUBBINGS

[75] Inventor: Giuseppe Saviolo, Palestro, Italy

[73] Assignee: Sant' Andrea Novara Officine Meccaniche e Fonderie S.p.A., Novara, Italy

[21] Appl. No.: 853,526

[22] Filed: Apr. 18, 1986

[30] Foreign Application Priority Data

Apr. 19, 1985 [IT] Italy ..... 67374 A/85

[51] Int. Cl.[4] ..... D01H 5/28; B65H 54/42; B65H 67/04

[52] U.S. Cl. ..... 57/331; 57/315; 57/328; 242/54.4

[58] Field of Search ..... 57/315–318, 57/327–331; 242/54.4

[56] References Cited

U.S. PATENT DOCUMENTS

| | | | |
|---|---|---|---|
| 2,925,961 | 2/1960 | Speak | 242/54.4 |
| 3,073,106 | 1/1963 | Tsuzuki | 57/315 X |
| 3,191,375 | 6/1965 | Naegeli | 57/315 X |
| 3,482,795 | 12/1969 | Mackie | 242/54.4 |
| 4,085,900 | 4/1978 | Marcio | 242/54.4 X |

FOREIGN PATENT DOCUMENTS

| | | | |
|---|---|---|---|
| 2112031 | 7/1983 | United Kingdom | 242/54.4 |

*Primary Examiner*—John Petrakes

*Attorney, Agent, or Firm*—Sughrue, Mion, Zinn, Macpeak and Seas

[57] ABSTRACT

A vertically-arranged rubbing finisher has a plurality of rubbing units each traversed vertically by a pair of slubbings which are directed to respective winding devices for winding on respective spools to form single-slubbing bobbins. The two winding devices receiving a respective pair of slubbings are disposed on opposite sides of a vertical, longitudinal plane of symmetry through the rubbing unit, the winding devices on each respective side forming a group including drive rollers for the respective spools arranged for rotation about a common horizontal axis. Each spool is pivotable away from its drive roller as its bobbin is formed on arms which, when the bobbin is completed, pivot further, downwardly, to deposit the bobbin on a conveyor belt for transfer from the machine before returning upwardly to collect a new, empty spool for filling from a supply device.

3 Claims, 5 Drawing Figures

VERTICALLY-ARRANGED RUBBING FINISHER HAVING SYMMETRICALLY-LOCATED OUTPUT BOBBINS WITH SINGLE SLUBBINGS

BACKGROUND OF THE INVENTION

The present invention relates to a vertically-arranged rubbing finisher having symmetrically—located output bobbins with single slubbings.

Rubbing finishers are already known in which the slubbings which pass through the drawing and rubbing units travel paths located in a common longitudinal vertical plane and which output bobbins with single slubbings.

In such known rubbing finishers, each rubbing unit is traversed by a pair of slubbings each of which is wound, with the aid of a twisting and guide device, on a spool carried by one of the two underlying groups of bobbin winding devices.

Each group of winding devices is constituted by a plurality of mutually-aligned, driven drive rollers, the common horizontal axis whereof is parallel to the length of the machine, and towards which the various spools on which the bobbins are to be formed are constantly thrust.

Each of these spools is supported at its end by a pair of arms mounted for rotation about axes parallel to the drive rollers and pivotable, possibly against the action of resilient means, so as to move the spool away from its drive roller.

Each group of winding devices is also disposed and arranged so that it can deposit the bobbin just formed on a movable cradle or tray arranged to transfer this bobbin to the outlet of the machine and so that it can receive a new, still-empty spool before the respective arms return to the starting position in which this spool contacts its drive roller, thus enabling the formation of a new single-slubbing bobbin.

In known practical embodiments of machines with the characteristics mentioned above—which will, for simplicity, be termed "rubbing finishers of the specified type" below—the two groups of winding devices are staggered relative to each other in height and are arranged so that, from the rubbing units, the slubbings reach one of them by moving in the vertical plane of symmetry of the groups while they reach the other after travelling a path which is inclined to this plane.

Moreover the groups of winding devices are arranged so that they can discharge their bobbins which have just been formed in two phases into the same trays or cradles and can take up new, still-empty spools from the same loaders.

Compared with conventional systems in which double-slubbing bobbins are formed, the machines in question have the indisputably great advantage of being able to exchange bobbins in the finisher, and also in the subsequent spinning stage, twice less frequently than is necessary when double-slubbing bobbins are output, with a consequent considerable increase in the productivity of the systems.

The known structure is not, however, without drawbacks. The fact that the groups of winding devices are staggered in height considerably increases the bulk of the machine in this direction.

At the end of their formation by the two separate groups of winding devices, the bobbins must, per force, be discharged in two successive phases, a first for discharging the bobbins formed by the upper groups of winding devices and then one for those formed by the lower winding devices. This doubles the time needed to carry out this stage in the automatic bobbin-exchange cycle.

Furthermore, because of the need to allow the bobbin-carrying arms and the bobbins themselves to effect the necessary rotational movements for the discharge, in the presence of each other, it is necessary to make the spools somewhat shorter than those usable in a double-slubbing bobbin finisher, for the same length of machine and number of bobbins.

The increased height of the machine makes access less easy, not only to some of the groups of winding devices but also to other parts such as the racks, rolls and rubbers.

Another serious disadvantage lies in the tension in the portions of the slubbings between the outlets from the rubbing groups and the winding devices, which have different lengths and inclinations to the median plane of symmetry of the rubbing groups. The result of this is, indeed, a difference in tension in the slubbings directed to the different winding devices giving an undesirable and often unforseeable variation in the quantity of slubbing wound on the bobbins formed by the different groups of winding devices and of the thread obtained from use of these slubbings in the subsequent spinning stage.

SUMMARY OF THE INVENTION

The object of the present invention is to provide a rubbing finisher of the type specified above which is free from the aforesaid disadvantages and—since these disadvantages must be attributed to the arrangement of the two groups of winding devices and to the structure of the respective devices for the automatic discharge of the bobbins which have just been formed and for the loading of the empty spools—confronts the technical problem of modifying the arrangement and structure in such a way as to reduce the height of the machine, to make it possible to use spools and to form bobbins having a length equal to those usable in machines which output double-slubbing bobbins, to reduce the time needed to carry out the stage in the automatic cycle of discharging the bobbins and loading the empty spools and finally to eliminate the disadvantage of obtaining bobbins wound with different quantities of slubbing.

According to the present invention this is achieved by providing a rubbing finisher of the type in which each rubbing unit is traversed by a pair of slubbings each of which is wound, with the aid of a tensioning and guide device, onto one of the spools mounted in one of the two underlying bobbin-winding devices, each of which is constituted by a plurality of mutually-aligned, driven drive rollers, the common horizontal axis whereof is parallel to the length of the machine, and towards which the empty spools on which the bobbins are to be formed are constantly thrust; each of these spools being supported at its ends by a pair of arms rotatably mounted about axes parallel to the drive rollers and pivotable, possibly against the action of resilient means, so as to move the said spool away from its drive roller; each of the winding devices also being disposed and arranged so that it can deposit the bobbin just formed on a movable cradle or tray arranged to transfer this bobbin to the outlet of the machine, and so that it can receive a new empty spool before the arms return to the starting position in which the spool contacts its drive roller, thus enabling the formation of a new single-slubbing bobbin, characterised in that the groups of bobbin-winding devices are disposed on opposite sides of the vertical plane of symmetry of the rubbing units in positions symmetrical about this plane.

BRIEF DESCRIPTION OF THE DRAWINGS

Further characteristics and advantages of the invention will become apparent from the description which follows with reference, by way of non-limiting example, to one practical embodiment illustrated in the appended drawings, in which.

DESCRIPTION OF THE PREFERRED EMBODIMENTS

Figure 1:
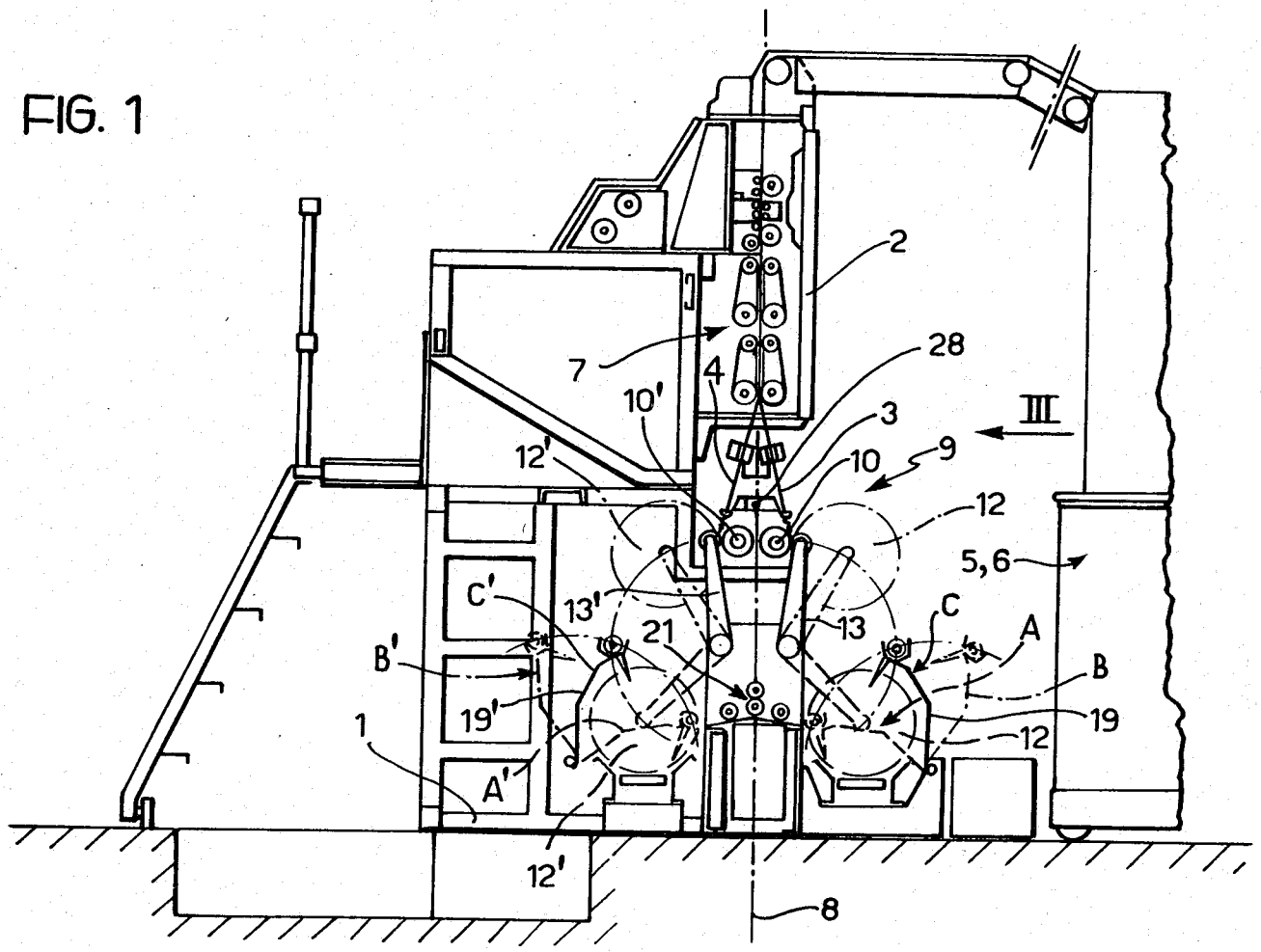
FIG. 1 is a schematic side-elevational view of the rubbing finisher according to the invention.

The rubbing finisher illustrated in the drawings includes a base 1 and an upper framework 2 containing a plurality of groups of rolls, each for drawing a respective pair of slubbings 3 and 4.

These slubbings are supplied to the rolls from above, starting from respective separate containers 5 and 6 located on the floor along one of the longitudinal sides of the machine. The rolls of the framework 2 are of the so-called "vertically-arranged" type and are arranged and driven so that the slubbings 3 and 4 being drawn follow vertically-descending paths.

Beneath each group of rolls is a rubbing unit 7 also arranged vertically. Each of these units includes two pairs of internally-grooved sleeves mounted on pairs of grooved rollers, cooperating in known manner, in pairs, in the longitudinal vertical plane of symmetry 8 common to all the groups.

At the output of each rubbing unit 7, the respective slubbings 3 and 4 are directed downwardly towards two bobbin-winding devices 9 and 9' respectively, belonging to the two separate groups of devices themselves, disposed symmetrically about the aforementioned vertical plane of symmetry 8 at which there is contact between the outer surfaces of the sleeves of the various rubbing units 7.

Each of the parts of the bobbin winding devices 9 and 9' associated with one of the two rubbing units includes a drive roller 10 and 10' respectively, the horizontal axis whereof is parallel to the length of the machine and is aligned with the axes of the corresponding drive rollers of the winding devices of the same group.

A spool 11 and 11' respectively contacts the periphery of each of these drive rollers 10 and 10'. Since the drive rollers 10 and 10' belong to two groups of winding devices 9 and 9', which are separate from each other and disposed, as stated above, symmetrically about the vertical plane 8, the portions of the slubbings 3 and 4 between the outlets of the respective rubbing units and the drive rollers 10 and 10' are inclined to this plane by the same amount which is kept within small limits.

The spool 11 on which the front bobbin 12 is to be formed by virtue of the winding of the slubbing 3 on to this spool contacts the drive roller 10 (see FIGS. 1 and 2) directly only at the beginning of the formation of the bobbin itself.

Figure 4:
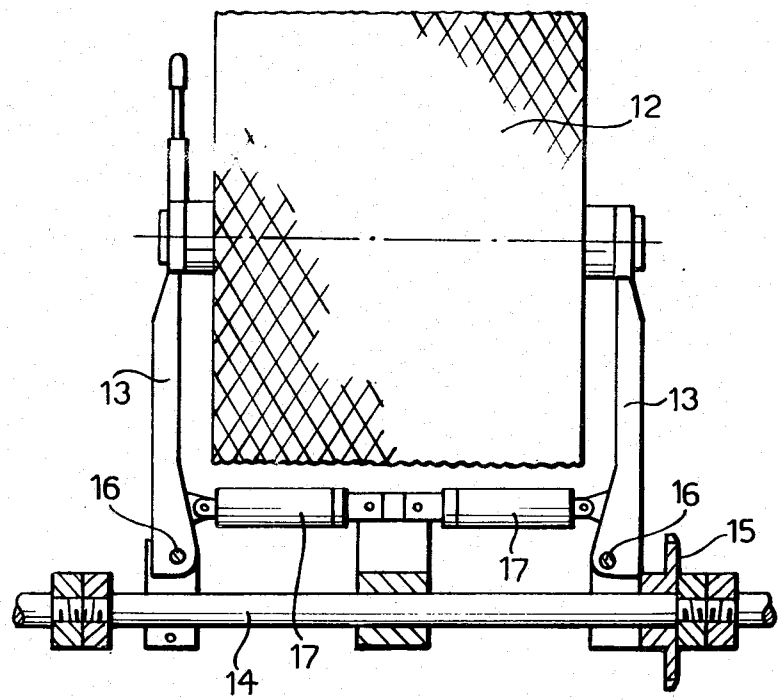
FIG. 4 is a front elevational view, on an enlarged scale, of a constructional detail of the rubbing finisher according to the invention.

Each spool 11 is supported by a pair of identical arms 13 projecting from a shaft portion 14 (see FIG. 4) rotatably mounted on the machine base 1 and pivotable by means of a chain (not illustrated) which acts on a sprocket 15 rigid with the shaft portion itself.

Figure 2:
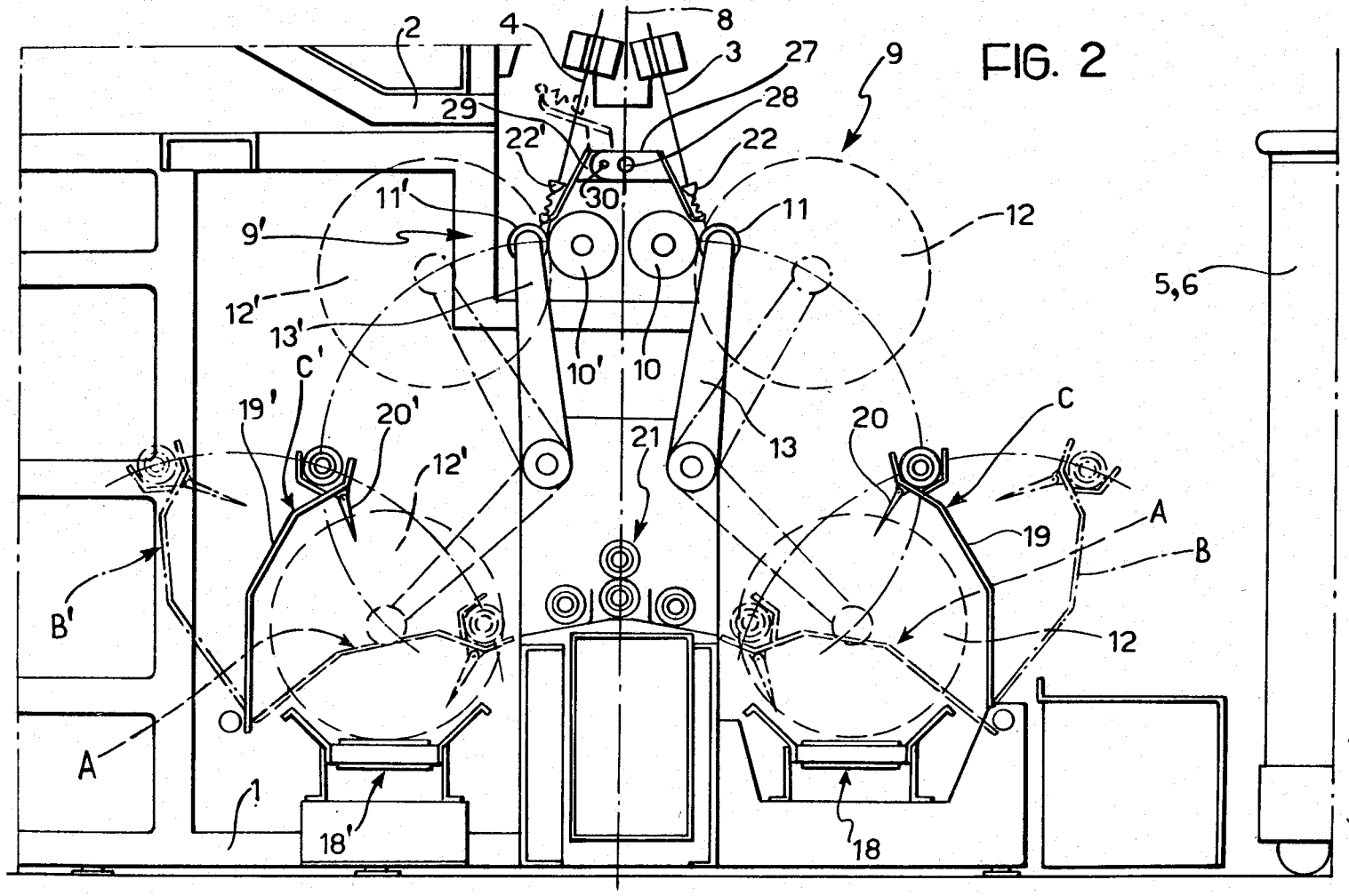
FIG. 2 is an enlarged view of part of it in side elevation.
Figure 3:
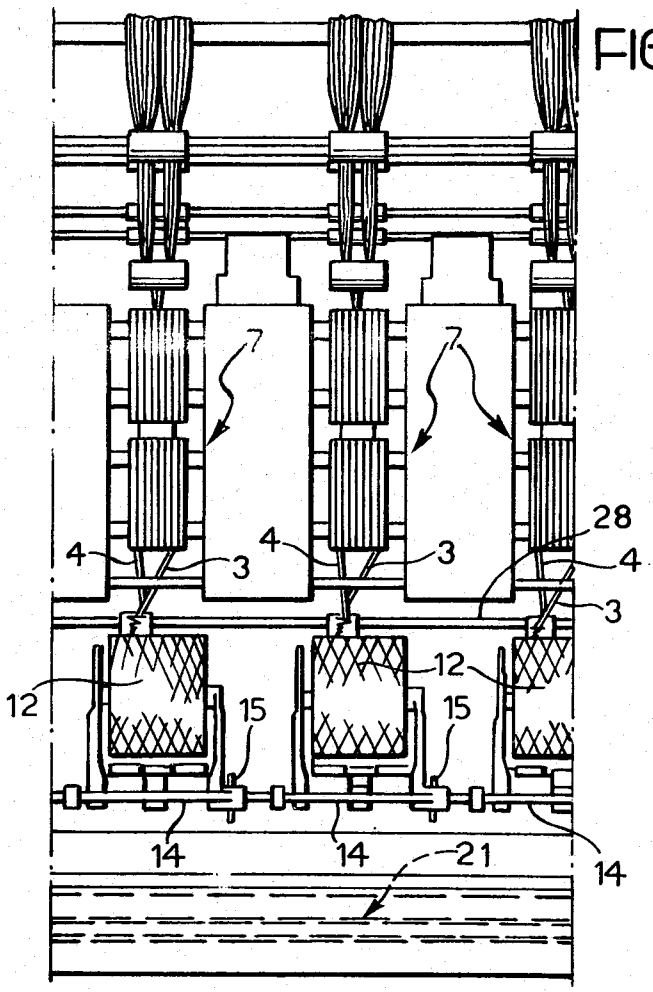
FIG. 3 is a front elevational view in the direction of the arrow III in FIG. 1.

The arms 13—which, after the formation of the bobbins 12, take up the positions indicated in chain line in FIGS. 1 and 3—are connected to the shaft portion 14 by transverse fulcri 16 which allow the arms themselves to open apart against the action of tension springs (not visible in the drawings since they are enclosed in housings 17), so as to allow the disengagement of the spool 11 with the bobbin 12 formed thereon.

This occurs at the end of the movement of the arms 13, with the spools 11 and the bobbins 12 formed on these spools, to the position indicated in broken outline in FIG. 3, so that the bobbin which has just been formed is discharged on to a conveyor belt 18 extending parallel to the length of the machine. The operation in question is preferably effected automatically by suitable mechanisms which are known (and hence not illustrated), carried by the base 1 and arranged to act on the arms 13 at the end of their downward rotation.

The movement of the bobbin 12 to the position indicated in broken outline is possible since, in a previous phase, the arm 19 for loading the spools is moved from the position A to the waiting position indicated B. Each spool-loader arm 19 carries, close to its free end, a resiliently-yieldable blade 20 which projects towards the plane 8. This is provided so that, when the arm 19 is in the waiting position indicated by the reference B, it interferes with the bobbin 12 during the descent of this latter towards the downward-travel limit, indicated in broken outline, and makes it rotate in a counter-clockwise direction so as to cause the automatic cutting of its slubbing.

Once the bobbin 12 has been discharged on to the conveyor 18, the arms 13—being kept in their opened condition—rise up again until they reach the same plane C as that in which the spool-loader arms 19 are located, these in the meantime having been moved to the position C, being rotated towards the plane of symmetry 8 from the position B. At this point the arms 13 close automatically by pivoting about the pins 16 under the action of the mechanisms mentioned above, and thus catch new spools 11.

Subsequently they continue their upward rotation (in a counter-clockwise direction in the drawing) until this new spool is brought into contact with the winding roller 10, which is maintained, in known manner, by a force of a predetermined value caused by the tension of one or more springs (not illustrated) on the arms 13.

In the meantime the conveyor belt 18 removes the bobbins 12 deposited thereon to suitable collecting places (not illustrated) located close to one of the opposing heads of the machine.

The spool-loader arm 19 is then moved to the position A, in which it receives another empty spool from a supplier-conveyor schematically indicated 21 located beneath the winding devices 9 and 9' of the two groups, and is subsequently returned to the waiting position B.

Figure 5:
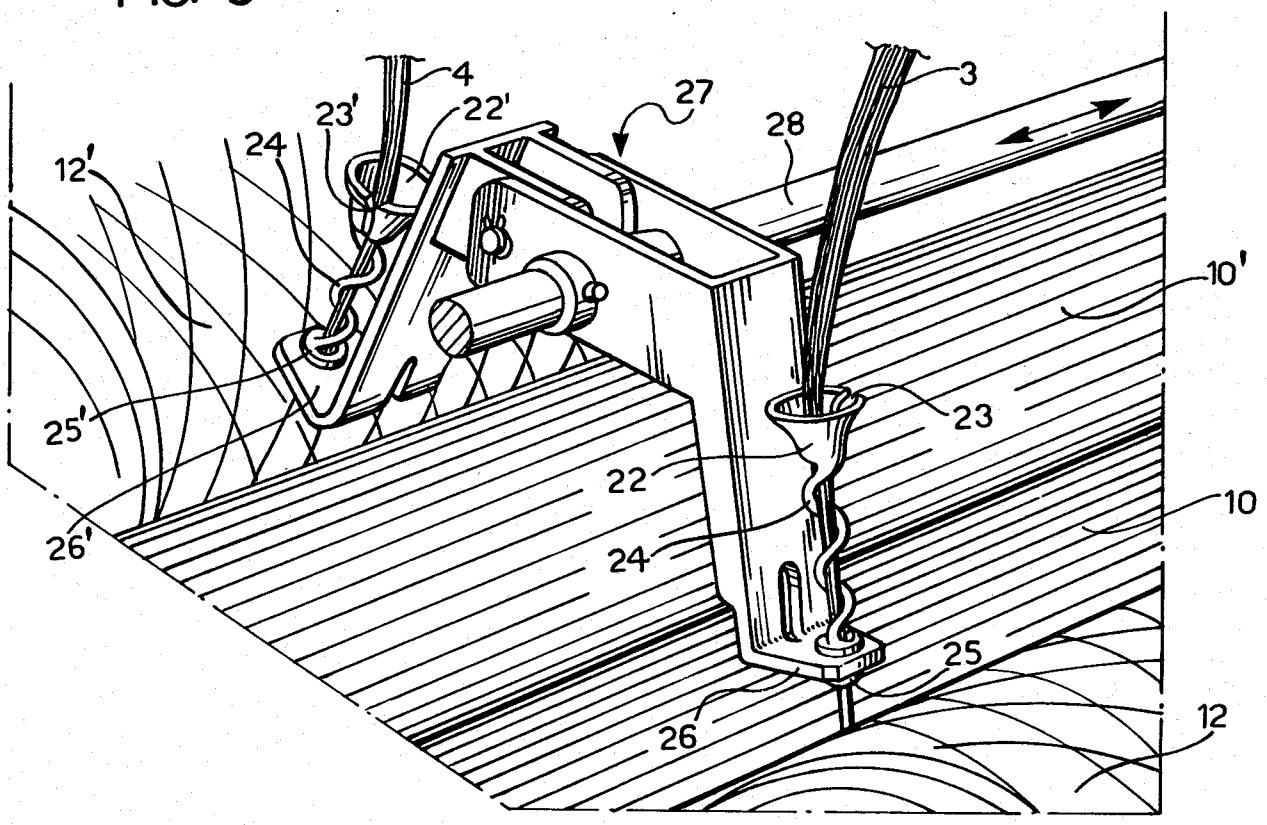
FIG. 5 is a perspective view, also on an enlarged scale, of another constructional detail of the rubbing finisher of the invention.

The structure and operation of each winding device 9' belonging to the group located on the other side of the vertical plane of symmetry B are identical to those of the device 9. To complete the above description it suffices to stress that, above each drive roller 10, there is a slubbing guide-twisting device of known type illustrated in FIG. 5. This includes an inlet element constituted by a ring 22 having a radial notch 23, to which one end of a helically shaped rod 24, preferably with a zero internal diameter, is fixed. The other end of this rod 24 carries the so-called "condenser" constituted by a bush 25 the bore of which has a diameter which narrows towards its outlet facing the zone of contact between the drive rollers 10 or 10'and the periphery of the respective spool 11 or 11', or of the corresponding bobbin being formed.

The body of the condenser 25 is gripped externally by a support clamp 26 carried by the lower lug of a slide 27. This latter is fixed to a longitudinal bar 28 of circular cross-section which is reciprocable, for example so that the speed and amplitude of its reciprocating movements are variable, by known mechanisms (not illustrated) carried by the framework 2 or the base 1 of the machine.

In order to allow most of the operations for reattachment of a slubbing (in case of accidental breakage) to be carried out by an operator located at the front of the machine—that is the side at which the front group of winding devices 9 are located—each slubbing guide twister of the winding devices 9' of the rear group is fixed to a support 29 connected to the slide 27 rigid with the bar 28 by means of a fulcrum 30. Thus, during the introduction of one of the slubbings 4 into the respective twister of the rear group, the respective support 29 may be pivoted upwardly until it is in the position indicated in broken outline in FIG. 3 and the operation of reintroducing the slubbing is thus facilitated.

The structural components of the rear winding devices 9' of the other group which are identical to those of the front winding devices 9 of the first group are indicated in the drawings by the same reference numerals with the addition of the symbol "'".

In summary, in the rubbing finisher of the invention, two bobbins are formed at the output of each rubbing unit under the action of winding devices belonging to groups disposed symmetrically about the vertical plane 8 at which contact occurs between the sleeves of the rubbing units disposed beneath the rolls, and each of these bobbins—which collects only one of the pair of slubbings leaving each rubbing unit—is supported by a pair of arms.

As stated above, this symmetrical arrangement of the groups of winding devices ensures that the extremely important advantage is obtained that the same quantity of slubbing is wound on each of the various bobbins.

During the "lifting", that is when the bobbins have been formed and have reached their set size, the winding devices of the two groups carry out the following succession of operations simultaneously: discharge of the bobbins, loading of the new spools and starting of the rewinding of the slubbings.

This results in an indisputable saving of time compared with the known solution specified at the beginning of the present description, while all the advantages of the known solution, which lie in the formation of bobbins with only one slubbing, are retained, these being: greater output from the rubbing finisher for a halved number of "lifts", greater autonomy of operation of the spinners supplied with the bobbins output by the rubbing finisher of the invention, on which it is possible to arrange about twice the quantity of material.

In addition to the above, it is seen that the symmetrical arrangement of the groups of winding devices allows the use of winding spools of a length equal to those usable in equivalent rubbing finishers which output double-slubbing bobbins, for the same length of machine and number and width of the intervals between the bobbins themselves, thus giving a further increase in the capacity of the bobbins.

A yet further advantage results from the height of the machine being kept equal to that of similar, known vertically-arranged rubbing finishers which output double-slubbing bobbins, without this necessitating an increase in the various members such as racks, rolls and rubbing units which, on the contrary, is essential in the known staggered-height solutions which output single-slubbing bobbins.

Finally it is seen that the invention has a further advantage in the great flexibility of the machine constituting its subject, both with regard to its structure and its use.

It is, in fact, possible to provide the machine during construction with both or only one of the possible bobbin-forming systems depending on the use foreseen for the finisher, with an output of single-slubbing or double-slubbing bobbins, the application of the second bobbin-forming system possibly being carried out at a subsequent time.

Similarly, a machine having both bobbin-forming systems arranged to make single-slubbing bobbins may be equipped to make double-slubbing bobbins in a short time with the use of only one of the two groups of winding devices (preferably the front one 9) without this necessitating the sacrifice of any of the functional characteristics of the machine, by the simple replacement of the existing twisting device with one suitable for guiding two slubbings.

What is claimed is:

1. A vertically-arranged rubbing finisher device for producing single-slubbing bobbins, comprising:

a base having an upper framework rubbing unit means defining a vertical plane of symmetry supported on said framework, said rubbing unit means comprising a plurality of vertically aligned rubbing units;

drawing unit means supported on said framework above and vertically aligned with said rubbing units;

a pair of bobbin-winding means disposed on opposite sides of said vertical plane of symmetry for winding a pair of slubbings subsequent to passage of the slubbings through said drawing unit means and each of said rubbing units, each bobbin-winding means including support means on said base for supporting a spool with the axis of the spool parallel to said plane of symmetry onto which a slubbing is wound;

drive rollers for rotating each spool, said rollers having axes disposed parallel to said plane of symmetry and the axes of said spools;

said support means including pairs of arms rotatably mounted about axes parallel to the axes of said drive rollers with each pair of arms adapted to support a spool on which a bobbin is to be formed, and biasing means for biasing said arms towards a respective drive roller;

movable transfer means mounted on said base; and said bobbin-winding means including means for depositing newly formed bobbins onto said movable transfer means and receiving a new empty spool before said arms return to a starting position wherein the spool contacts its respective driven roller to begin formation of a new single-slubbing bobbin.

2. A rubbing finisher as claimed in claim 1, wherein said transfer means is comprised of a pair of conveyor belts on said base extending parallel to said plane of symmetry and each said pair of arms for supporting a spool is rotatable about the axes thereof so as to allow the movement of said spool away from the corresponding drive roller during the formation of a bobbin and further downwardly so as to be able to deposit said bobbin on a respective conveyor belt.

3. A rubbing finisher as claimed in claim 1 further comprising: spool loader means pivotally mounted on said base adjacent each pair of said arms and feeding means located on said base close to said vertical plane of symmetry and in a zone underlying said drive rollers for supplying empty spools to said spool loader means whereby upon pivotal movement of said arms and said spool loader means a spool will be transferred to each pair of arms.

* * * * *